United States Patent [19]

Harrop et al.

[11] 4,418,522

[45] Dec. 6, 1983

[54] KNOCKOFF CONTROL SYSTEM AND APPARATUS FOR TEXTILE STRAND TWIST FRAMES

[75] Inventors: Kenneth T. Harrop; Robert D. McArtor, both of Newark, Ohio

[73] Assignee: Owens-Corning Fiberglas Corporation, Toledo, Ohio

[21] Appl. No.: 278,306

[22] Filed: Jun. 29, 1981

[51] Int. Cl.[3] ..... D01H 7/22; D01H 13/16

[52] U.S. Cl. ..... 57/80; 57/83; 57/88; 242/35.5 R

[58] Field of Search ..... 57/78, 79, 80, 83, 81, 57/264, 88; 242/35.5 R

[56] References Cited

U.S. PATENT DOCUMENTS

| | | | |
|---|---|---|---|
| 2,375,605 | 5/1945 | Winslow | 57/80 |
| 2,449,682 | 9/1948 | Winslow | 242/35.5 R |
| 3,169,361 | 2/1965 | White | 57/81 X |
| 3,364,670 | 1/1968 | Stiepel et al. | 57/81 X |
| 4,122,654 | 10/1978 | Oswald | 57/80 X |

*Primary Examiner*—Donald Watkins

*Attorney, Agent, or Firm*—Ronald C. Hudgens; Philip R. Cloutier; Charles E. Moore

[57] ABSTRACT

The disclosure embraces a method of and apparatus for transferring dual strands or bundles of filamentary material from a rotating single supply package or creel package onto bobbins mounted on first and second rotating spindles, the method and apparatus involving the use of a control unit, stop motion assembly or knockoff device for each strand or bundle, the control units, stop motion assemblies or knockoff devices having a mechanical interconnection established whenever one of the strands or bundles breaks or sustains loss of tension whereby the rotation of the supply package and the rotation of the two spindles mounting strand or bundle receiving bobbins are interrupted.

2 Claims, 7 Drawing Figures

KNOCKOFF CONTROL SYSTEM AND APPARATUS FOR TEXTILE STRAND TWIST FRAMES

TECHNICAL FIELD

The invention relates to a method of and apparatus for winding strands of filaments or fibers from supply packages or creels onto rotating bobbins and of controlling the drive arrangement for supply packages and strand collector bobbins in event of strand breakage.

BACKGROUND ART

It has been conventional practice particularly in the glass fiber or filament field to attenuate glass streams flowing from a bushing into continuous fibers or filaments by winding a strand or linear group of the filaments into a package usually referred to as a creel package. The creel packages are then placed upon supports of a twist frame and the strand from each creel package transferred or wound by the apparatus of the twist frame onto a rotating bobbin or spool mounted on a driving spindle.

In such prior arrangements feed rolls engaging the strand were employed to withdraw the strand from the creel package and the strand fed to a rotating bobbin. In event of a strand breakage the feed rolls would be stopped.

Endeavors have been made to utilize creel or supply packages with two strands on a package wherein each strand is transferred or wound onto a separate bobbin or spool. Such endeavors have not been satisfactory because if one strand breaks out, the creel continues to rotate usually resulting in the winding of a doubled strand on the other bobbin.

DISCLOSURE OF THE INVENTION

The present invention relates to a method of and apparatus for controlling the transfer of two strands or bundles of fibers or filaments from a supply or creel package onto two bobbins or spools wherein each of the two strands is would upon a separate spool or bobbin, such winding apparatus being usually referred to as a twist frame.

The invention resides in a method of and apparatus involving a control unit, stop motion assembly or knockoff device for each of the two strands from a creel package wherein the control units, stop motion assemblies or knockoff devices are connected or interrelated so that whenever one of the strands of the pair breaks, the rotation of the supply creel or supply package is interrupted and rotation of the two spindles containing the strand receiving bobbins or spools will be interrupted.

For example, the right-hand knockoff device controls the driving of the creel package or supply package and the right-hand spindle and bobbin. When the right-hand strand breaks that is associted with the right-hand knockoff device, this device will be activated stopping the rotation of the creel package and the right-hand spindle and its bobbin.

The left-hand spindle and its bobbin will continue to run, but no take-up of strand on the left-hand spindle will occur since rotation of the creel package has been stopped. The build-up of twist on the left-hand bobbin carried by the left-hand spindle will cause the left-hand strand to break and the left-hand knockoff device activated to stop rotation of the left-hand spindle and bobbin.

A different sequence of actions or functions occurs when the left-hand strand being wound on the bobbin on the left-hand spindle breaks out. When the strand being wound on the left-hand bobbin breaks, the left-hand knockoff device will be activated. The activation of the left-hand knockoff device stops rotation of the left-hand spindle and the bobbin carried thereby and, through the establishment of a mechanical interconnection to the right-hand knockoff device, the right-hand knockoff device is activated.

When the right-hand knockoff device is activated, rotation of the right-hand spindle and the supply package or creel package will be stopped. Through the method and arrangement of the invention, in event of break-out of either of the two strands, rotation of both spindles and bobbins and the creel package will be stopped.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawings.

BRIEF DESCRIPTION OF THE DRAWINGS

The details of the invention will be described in connection with the accompanying drawings in which.

BEST MODE FOR CARRYING OUT THE INVENTION

The method of the invention and the apparatus or system for carrying out the method are adapted for transferring or winding two strands, yarns or linear groups of textile fibers or filaments contained on a single supply package or creel package of a twist frame wherein one strand is wound on a right-hand bobbin and the other strand wound on a left-hand bobbin and wherein a stop motion device or knockoff unit is associated with each strand, the stop motion devices or knockoff units being interrelated wherein breakage of one strand activates a unit to interrupt rotation of the creel package and interrupt transfer or winding of the strands onto both bobbins.

Figure 1:
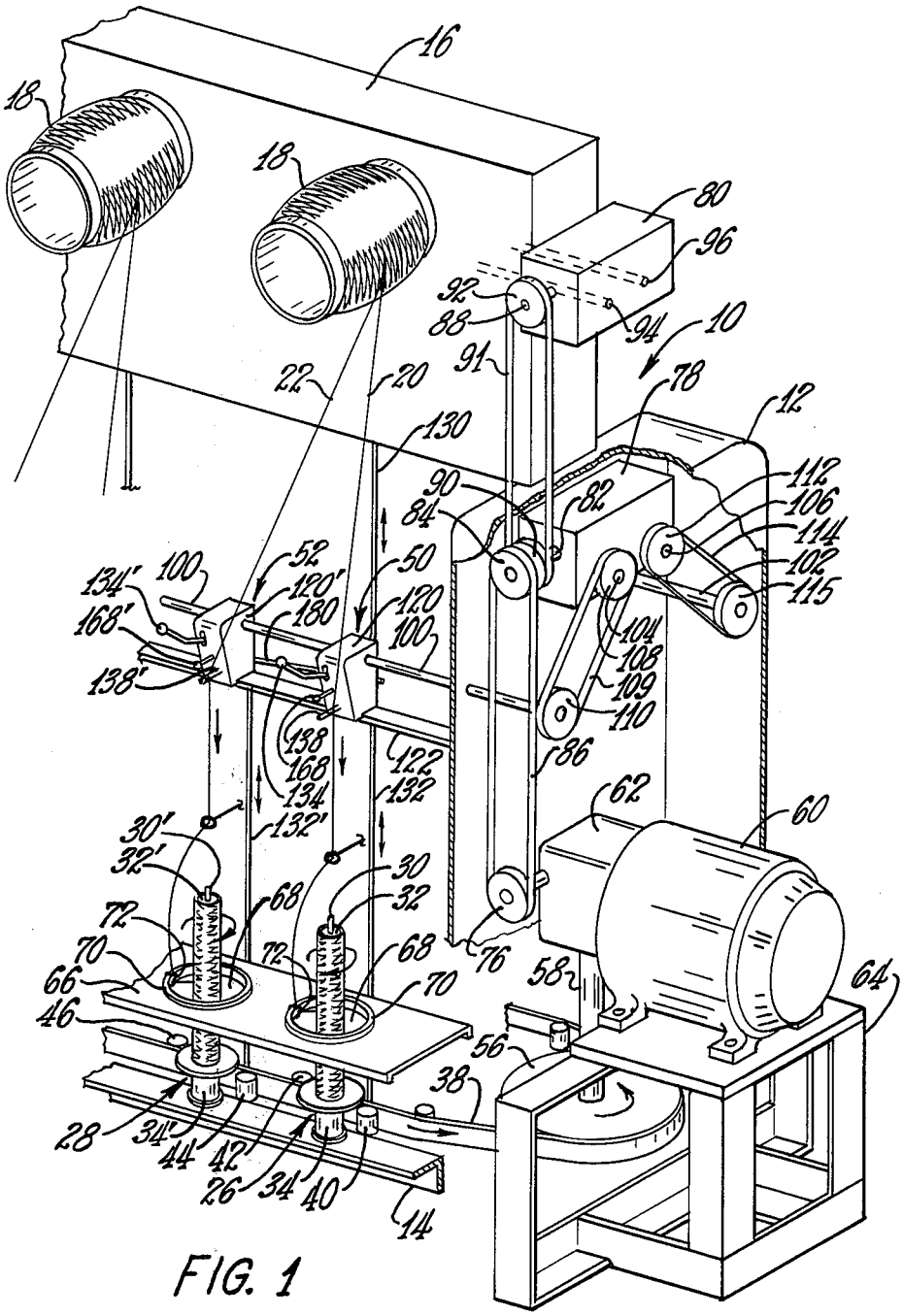
FIG. 1 is an isometric view of a portion of a strand twisting apparatus or twist frame wherein a driven creel package has two strands, the apparatus embodying a stop motion or knockoff device for each strand activated by strand breakage.

Referring initially to FIG. 1 there is illustrated schematically a portion of an apparatus or twist frame construction embodying the invention for winding two strands from a supply package or creel package, one strand onto a right-hand bobbin and the other strand onto a left-hand bobbin. The twist frame or apparatus is of a character for supporting and driving a number of creel packages and twice the number of bobbins upon which the individual strands are wound.

The winding apparatus or twist frame construction 10 comprises a frame structure which includes two end frames or housings 12, one of the end frames or housings being illustrated in FIG. 1. The housings or end frames are connected by bolster rails 14, one of which is shown in FIG. 1 and by a creel frame 16, the latter adapted to support supply packages or creel packages of dual strands, yarns or linear groups of filamentary materials such as glass fibers or filaments.

The end frames or housings 12 are connected by other frame or structural members (not shown). The creel frame or structure 16 is equipped with rotatable supports or mandrels (not shown) each mandrel adapted to support a supply package or creel package 18, each package comprising at least two strands or yarns, namely a right-hand strand or yarn 20 and a left-hand strand or yarn 22 such as textile strands or yarns to be twisted and packaged by the twist frame or apparatus.

A bolster rail 14 is arranged at each side of the apparatus, each bolster rail supporting pairs of spindle units, each pair comprising a right-hand or first spindle unit 26 and a left-hand or second spindle unit 28, one pair being illustrated in FIG. 1. It is to be understood that a number of similar units is arranged or supported upon a bolster rail on the opposite side of the machine and a second row of creel supporting mandrels or supports (not shown) is mounted on the opposite side of the creel frame 16.

The right-hand or first unit 26 includes a spindle 30 supporting a bobbin or spool 32, the spindle 30 being equipped with a whorl 34. The left-hand or second unit 28 includes a spindle 30' supporting a bobbin or spool 32', the spindle 30' being equipped with a whorl 34'. The whorls 34 and 34' and the other whorls of other spindles are adapted to be engaged by an endless driving belt 38 for rotating the spindles and the bobbins or spools upon which the strands, yarns or linear groups of filamentary materials are collected.

Idler rolls 40 and 42 are disposed adjacent the whorl 34 and idler rolls 44 and 46 are disposed adjacent the whorl 34'. The pairs of idler rolls normally bias the driving belt 38 in engaging relation with the whorls 34 and 34' for rotating the spindles 30 and 30' and the bobbins 32 and 32' mounted on the spindles. An idler roll of each pair of idler rolls 40 and 44 is controlled as hereinafter described for guiding the driving belt 38 toward or away from each whorl to selectively establish or interrupt a drive connection to each spindle and the bobbin mounted thereby.

A stop motion device, assembly or control unit is provided for each strand for controlling the drive for the creel package 18 and the drive for the spindles on which the strands are collected. A right-hand stop motion device, assembly or control unit 50 has means engaged with the right-hand strand or yarn 20 and a similar left-hand stop motion device, assembly or control unit 52 has means engaged with the left-hand strand or yarn 22. These devices will be hereinafter described and their operating functions explained in event of strand or yarn breakage.

The endless driving belt 38 extends lengthwise of the twist frame 10 and is engaged with a drive pulley 56 mounted upon a shaft 58 driven by an electrically energizable motor 60 through power transmission mechanism of conventional construction contained within a housing 62 supported adjacent the motor 60. The motor 60 is supported upon a supplemental frame 64.

The twist frame construction 10 includes conventional ring rails 66, one of which is shown in FIG. 1, a second rail (not shown) being disposed at the opposite side of the twist frame. Each ring rail 66 is mounted for reciprocation in a vertical direction and is reciprocated by conventional means (not shown) driven by the motor 60. Each ring rail is fashioned with circular openings, two being shown at 68 accommodating the spindles 30 and 30' and the bobbins 32 and 32'.

Each circular opening 68 is defined by a circular track or ring 70 on which is mounted a traveler or flyer 72 which is freely movable on the track for rotation around the adjacent spindle and bobbin. The strand 20 is threaded through the flyer 72 adjacent the right-hand or first spindle 30 and the strand or yarn 22 is threaded through the flyer 72 adjacent the left-hand or second spindle 30'.

In the twist frame construction illustrated, a drive mechanism is provided for rotating the mandrels (not shown) supporting the creel packages or supply packages 18 of strands or yarns 20 and 22 and for driving or oscillating a shaft or shaft means associated with components of the stop motion devices, assemblies or control units 50 and 52. A pulley 76 is driven by the motor 60 through transmission mechanism contained in the housing 62. Disposed within the frame housing 12 is a supplemental housing or enclosure 78. Associated with an end of the creel frame construction 16 is a second supplemental housing 80. Extending into the supplemental housing 78 is a shaft 82. Mounted on the shaft 82 is a pulley 84 connected by an endless belt 86 with the driving pulley 76.

A shaft 88 is jounralled within the supplemental housing 80. A pulley 90 on the shaft 82 is connected by an endless belt 91 with a driven pulley 92 mounted on the shaft 88. Disposed within the supplemental housing 80 is a conventional mechanism for driving shafts 94 and 96, these shafts extending lengthwise of the creel frame 16.

Each of the mandrels at the front side of the creel support frame 16, on which packages 18 are mounted, is provided with conventional clutch means (not shown) individual to each mandrel associated with the shaft 94 for establishing or disestablishing a drive to each of the mandrels on the front side of the frame 16. The shaft 96 establishes a similar drive means through individual clutches to the individual package supporting mandrels extending from the opposite side of the creel support frame 16.

Journaled in bearings mounted by the end frames 12 of the creel frame structure are shafts 100 and 102. Journaled in the supplemental housing 78 are shafts 104 and 106. Shaft 104 is provided with a pulley 108 connected by an endless belt 109 with a pulley 110 mounted on the shaft 100. The shaft 106 is provided with a pulley 112 connected by an endless belt 114 with a pulley 115 mounted on a shaft 102.

The power transmission mechanism within the supplemental housing 78 is adapted to oscillate the shafts 104 and 106 which oscillatory movements of the shafts 104 and 106 are transferred by the pulleys and belts to the shafts 100 and 102 to effect oscillatory movements of the shafts 100 and 102. The functions and purposes for oscillating the shafts will be hereinafter described.

The stop motion devices, assemblies or control units 50 and 52 of the invention are adapted for controlling, establishing or interrupting the drive to the first creel package 18 supplying strands to the right and left-hand bobbins and particularly for interrupting the drive to the spindles supporting the bobbins and the creel package in event of breakage of either the right-hand or first strand or left-hand or second strand.

Figure 2:
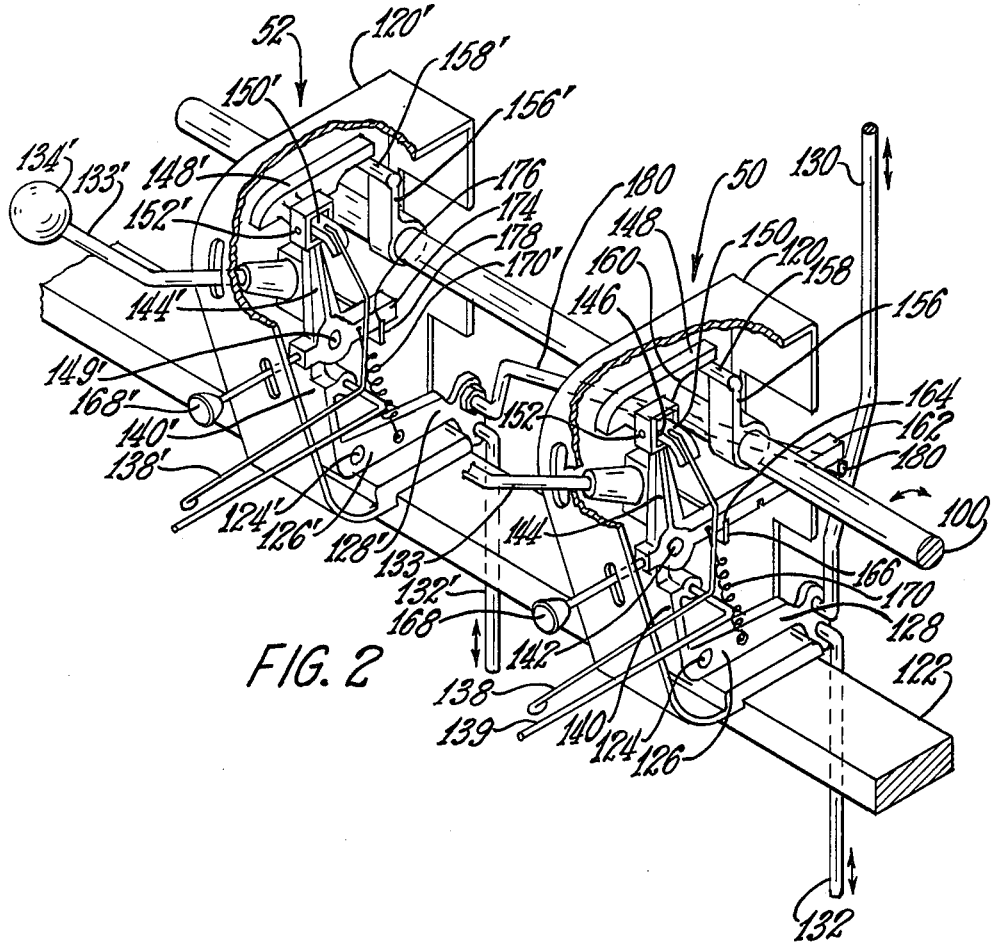
FIG. 2 is an isometric view illustrating portions of right-hand and left-hand stop motion devices or knockoff assemblies of the invention.

FIG. 2 illustrates the first or right-hand stop motion device, assembly or control unit 50 and the left-hand or second stop motion device, assembly or control unit 52, certain parts of the housings of the units being broken away for purposes of illustration. Certain assemblages of components of the stop motion devices or control units are illustrated in FIGS. 3 through 7.

The right-hand or first stop motion device or control unit 50, particularly shown in FIG. 2, is inclusive of a housing 120, the housings of the units being supported upon a longitudinally extending frame member or means 122 shown in FIGS. 1 and 2. Disposed within the housing 120 are components of a mechanism for establishing or interrupting the drive to the mandrel supporting the creel package 18 and the drive to the spindle 30 and the spool or bobbin 32 in event of breakage of the first or right-hand strand or yarn 20.

Pivotally supported or fulcrumed on a pin or shaft 124 in the housing 120 is a bell crank, lever or member 126, the shaft 124 being supported by the housing 120. Pivotally connected to the end region of the horizontal portion 128 of the bell crank 126 is an upwardly extending rod or member 130, the upper end of which is connected with a clutch means (not shown) in a conventional manner for establishing or interrupting the drive connection to the mandrel supporting the first supply package or creel package 18.

Also pivotally connected to the end region of the horizontal portion 128 of the bell crank 126 and extending downwardly is a second rod or member 132 which is connected in a conventional manner (not shown) with the idler roll 40 for establishing or interrupting a drive to the whorl 34 from the belt 38 by exerting pressure on the belt toward or away from the whorl 34. In this manner a drive is established or disestablished to the spindle 30 and the bobbin 32 depending upon the relative position of the bell crank or member 126.

Figure 4:
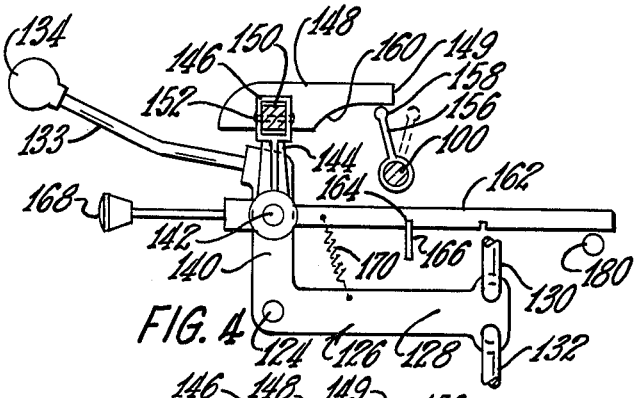
FIG. 4 is a side view of a portion of the mechanism of the right-hand stop motion control unit in normal strand winding position.

The tension of the strand 20 normally controls means within the housing 120 for maintaining the bell crank 126 in the position shown in FIG. 4 wherein the rods 130 and 132 are at their lowermost positions in which positions a drive for the mandrel supporting the first creel package 18 is established and the drive for the spindle 30 and bobbin 32 is established. The tilted position of the bell crank or lever 126 shown in FIG. 7 with the rods 130 and 132 in their uppermost positions interrupts the drive to the mandrel supporting the creel package 18 and the spindle 30 and bobbin 32.

Figure 7:
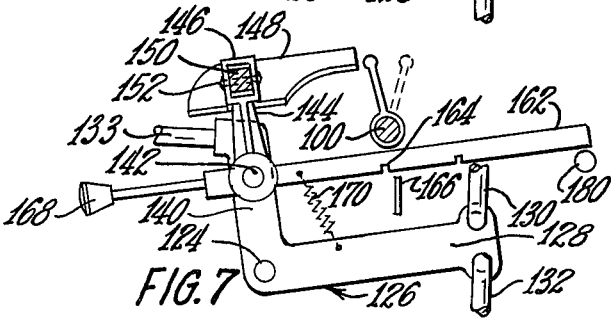
FIG. 7 is a view similar to FIG. 6 illustrating the position of the components in interrupting rotation of the creel package and the right-hand spindle and bobbin.

The bell crank 126 and the rods 130 and 132 are normally urged by conventional spring means (not shown) to their uppermost position shown in FIG. 7 to disestablish a drive to the mandrel supporting the creel package 18 and the drive to the spindle 30 and bobbin 32. An upper portion of the lever or bell crank 126 is provided with a rod or bar 133 equipped with a handle portion or hand grip 134 whereby the bell crank 126 may be reset to the position shown in FIG. 4 to re-establish a drive connection to the mandrel supporting the creel package 18 and the spindle 30 and bobbin 32.

The right-hand or first strand 20 is engaged with or bears against a trip wire or member 138 exerting stress or force against the trip wire. The trip wire is associated with means contained within the housing 120 for controlling the establishment or disestablishment of a drive to the mandrel supporting the creel package 18 and the spindle 30 and bobbin 32.

A guide wire 139 for the strand is disposed adjacent the trip wire 138 as shown in FIG. 2. The first or right-hand strand 20 is held in one position by the force or tension of the strand 20 on the trip wire or member 138.

With particular reference to FIGS. 2, 3, 4 and 5 the upwardly extending portion 140 of the bell crank 126 supports a stub shaft or pivot pin 142. Pivotally mounted upon the pivot pin 142 and extending upwardly is a member 144. The upper end region of the member 144 is fashioned with a box-like hollow portion 146. Disposed adjacent the hollow portion 146 is a counterbalance or member 148.

Figure 3:
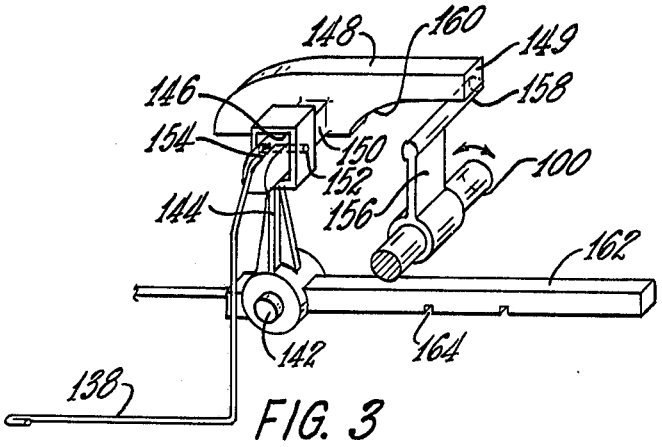
FIG. 3 is a fragmentary isometric view of a portion of the mechanism of the right-hand stop motion control unit or knockoff assembly.
Figure 5:
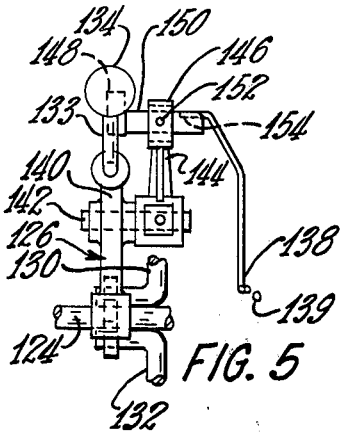
FIG. 5 is an end elevational view of the arrangement shown in FIG. 4.

The member 148 is provided with a transversely extending portion or projection 150 which extends through the hollow configuration of the portion 146 as particularly shown in FIGS. 3 and 5. The extension or portion 150 is pivotally supported by a pivot pin 152 extending through the hollow or box-like portion 146 and through an opening in the extension or transversely extending portion 150 of the counterbalance 148.

An end portion 154 of the trip wire 138 is engaged with and secured to the transversely extending portion or extension 150 of the counterbalance 148 so that the counterbalance 148 is pivotally supported for relative movement about the axis of the pin 152. Movement of the trip wire 138 causes pivotal movement of the counterbalance 148 about the axis of the pin 152.

Mounted upon the shaft 100 adjacent the counterweight 148 is a member 156 having a projection 158 which, during normal operation of the twist apparatus, is disposed beneath a projecting portion of the counterbalance as shown in FIGS. 2, 3 and 4. The counterbalance 148 is provided with a curved surface 160. As shown in FIGS. 2, 3 and 4 during oscillation of the shaft 100 the projection 158 on the member 156 oscillates beneath the curved surface 160 so that the projection 158 is maintained below the counterbalance 148 and does not engage the counterbalance.

Means is provided for maintaining the member 126 in the position shown in FIGS. 2 and 4 with the rods 130 and 132 in their lowermost positions establishing drive connections for the mandrel supporting the creel package 18 and the spindles 30 and 30′ mounting the bobbins 32 and 32′. The member 144 is provided with a projecting member or portion 162, the portion 162 being integral with or secured to the member 144.

The projecting member 162 functions as a latch member and is formed with a notch 164 adapted to be engaged with a detent, dog or plate 166 which is stationary and may be secured to the housing 120. The member 162 is normally held by the detent or plate 166 in the position shown in FIGS. 2 and 4 during normal winding operations of the twist frame.

The member 162 is fashioned with a hand grip or handle member 168 for the purpose of manually releasing the member 162 from engagement with the detent 166 if desired. A contractile coil spring 170 is connected to the member 162 and the bell crank 126, the spring 170 normally biasing the member 162 into latching engagement with the detent 166.

The functioning of the apparatus of the control unit or stop motion device 50 during normal winding operations and its functioning upon break-out or lack of tension in the right-hand strand 20 will now be described. The tension of the right-hand strand 20 from the first creel package 18 causes the strand to bear against the trip wire 138 holding the counterbalance 148 in its uppermost position, the rods 130 and 132 being in their lowermost positions held in such position by engagement of arm 162 with detent 166 counter to spring means (not shown) for effecting a driven to the creel package 18 and the spindle 30 and bobbin 32 onto which strand 20 is to be wound.

The shaft 100 oscillates continuously through the mechanism contained in the supplemental housing 78 and operated by the motor 60. In this position the latch bar or member 162 is urged by the spring 170 into engagement with the detent 166, the detent engaging in the notch 164 in the member 162. The detent holds the member 162 and bell crank 126 in the positions shown in FIG. 4 with the rods 130 and 132 in drive establishing positions.

In event of breakage of the first or right-hand strand 20, the tension or force of the strand on the trip wire 138 is relieved or removed. With the tension removed from the trip wire 138, the counterbalance 148 swings downwardly about the pivot pin 152 from the position shown in FIGS. 2, 3 and 4 to the position shown in FIGS. 6 and 7. The downward pivotal movement of the counterbalance 148 moves the counterbalance so that the end 149 of the counterbalance is engaged by the projection 158 on the member 156.

Figure 6:
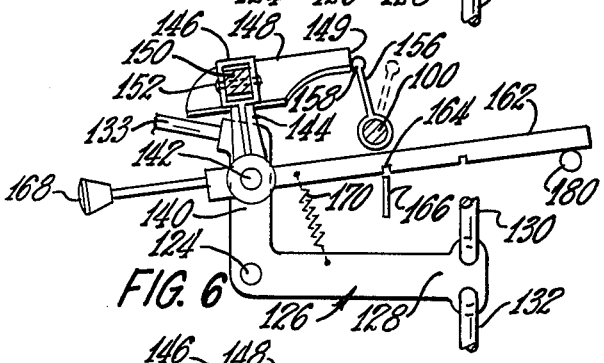
FIG. 6 is a view of the arrangement shown in FIG. 4 illustrating the position of the components of the right-hand stop motion unit activated from the left-hand stop motion unit by reason of breakage of the left-hand strand.

The movement of the oscillating member 156 is transmitted to the counterbalance 148 moving the counterbalance and member 144 to the position shown in FIGS. 6 and 7. This movement of the member 144 causes the latch member 162 to pivot around the axis of the shaft 142 to the position shown in FIGS. 6 and 7 disengaging the member or latch means 162 from engagement with the detent or plate 166.

Under the influence of the spring means (not shown) associated with the rods or members 130 and 132, the rods 130 and 132 are moved upwardly interrupting the drive to the first creel package 18 and interrupting the drive to the spindle 30 and bobbin 32, and the bell crank 126 moved or tilted to the position shown in FIG. 7.

As the first strand or right-hand strand 20 is broken, the drive to the mandrel supporting the first creel package 18 is interrupted, the drive to the spindle 30 and bobbin 32 is interrupted, and no further winding of the strand or yarn 20 takes place on the bobbin 32. However, as the drive to the first creel package 18 has been interrupted, the left-hand or second strand 22 is not fed to the bobbin 32' which is still rotating.

Continued rotation of the bobbin 32' exerts high tension or stress in the left-hand or second strand 22 causing the strand 22 to be broken and, through the mechanism contained in the control unit or stop motion device 52 hereinafter described, the drive to the spindle 30' and the bobbin 32' is interrupted so that no further winding of the strand or yarn 22 occurs on the bobbin 32'. The resetting operations of the control units or stop motion devices 50 and 52 will be hereinafter described.

The components of the left-hand control unit, stop motion device or assembly 52 are similar to or identical with components heretofore described in the right-hand control unit, stop motion device or assembly 50 and are contained within a housing 120' which is substantially identical with the housing 120. The functioning of the control unit, stop motion device or assembly 52 is activated by a breakage of the left-hand strand or yarn 22.

The apparatus of the control unit or stop motion assembly 52 is equipped with means for establishing a mechanical interconnection with mechanism of the control unit or stop motion assembly 50 for interrupting the drive to the mandrel supporting the creel package 18 and interrupting the drive to the right-hand spindle 30 and bobbin 32.

The control unit or stop motion assembly 52 includes a housing 120'. The left-hand strand or yarn 22 engages the trip wire 138' which is connected with the projection 150' on the counterbalance 148' pivotally supported by a pivot pin 152' to the upper hollow portion of a member 144', the member 144' being supported upon a pivot pin or shaft 142'. A bell crank or lever 126' is pivoted upon a shaft 124' and the shaft or pin 142' is mounted upon the upwardly extending arm portion of the bell crank 126'.

Mounted upon the shaft 100 is a member 156' having an extension 158' adjacent the counterbalance 148' but normally not in engagement with the counterbalance. The member 144 is integral with a projecting member 174 which is similar to the projecting member 162 but of shorter length.

The member 174 has a notch 176 for engagement with a detent 178. The member 144' is provided with a handle 168'. The upwardly extending portion 140' of the bell crank member 126' is provided with a rod 133' equipped with a handle or hand grip portion 134'. The member 174 is biased in a clockwise direction about the axis of the pin or shaft 142' by a contractile spring 170' connected with the bell crank 126'.

An end region 128' of the bell crank 126' has a pivotal connection with the upper end region of a rod 132' which is connected with an idler roll 44 shown in FIG. 1 for establishing or disestablishing a drive to the left-hand or second spindle 30' and bobbin or spool 32'.

A connecting means or mechanical connection is adapted to be established between the bell crank 126' of the stop motion assembly or control unit 52 and the mechanism in the stop motion assembly or control unit 50 so that in event the second or left-hand strand or yarn breaks, the components of the stop motion assembly or unit 50 will be activated by the stop motion assembly or control unit 52 to disestablish or interrupt the drive to the mandrel supporting the first creel package 18 and the drive to the right-hand spindle 30 and bobbin 32.

Secured to the end 128' of the bell crank or lever 126' is a means, member or rod 180 shown in FIG. 2 which extends through an opening in the housing 120 to a position adjacent and beneath an end region of the member 162. The member or rod 180 is close to the member 162 as shown in FIGS. 2 and 4 but normally does not exert any upward pressure upon the member 162.

When the left-hand or second strand or yarn 22 is broken, the components of the control unit 52 are activated, the bell crank or lever 126' is pivoted in a counterclockwise direction about the axis of the pin 124' thus elevating the rod 132' to disengage the drive to the left-hand or second spindle 30' and bobbin 32' thereon.

The rod or member 180 is moved upwardly by the bell crank 126' causing the member 162 to be disengaged from the detent or plate 166 so that the bell crank 126 is elevated causing rods 130 and 132 under the influence of spring means (not shown) to interrupt the drive to the mandrel supporting the first creel package 18 and interrupt the drive to the right-hand or first spindle 30 and bobbin 32 mounted thereon.

The functioning of the components of the stop motion assemblies or control units upon breakage of the right-hand or first strand or yarn 20 or upon breakage of the left-hand or second strand or yarn 22 will now be described. The following is a description of the operation of the components of the stop motion assemblies or control units 50 and 52 upon breakage of the right-hand or first strand or yarn 20.

During normal winding operations of the strands or yarns from the first creel package 18 to the bobbins 32 and 32', the right hand or first strand or yarn 20 is engaged with and bears against the trip wire 138 and the left-hand or second strand or yarn 22 is engaged with and bears against the trip wire 138'. The tensions of the strands or yarns on the trip wires 138 and 138' maintain the counterbalances 148 and 148' above the paths of oscillations of the projections 158 and 158' on members 156 and 156' mounted upon the oscillating shaft 100.

The member or bar 162 is engaged with the detent 166 retaining the bell crank 126 in a position illustrated in FIG. 4 with the rods 130 and 132 in their lowermost positions against the pressure of spring means to establish a drive to the mandrel supporting the first creel package 18 and the spindle 30 mounting the bobbin 32 on which the right-hand or first strand 20 is being wound.

In reference to the stop motion device or control unit 52 shown in FIG. 2, the member or bar 174 is engaged with the detent 178 which holds the bell crank or lever member 126' in a position similar to that of the bell crank 126 shown in FIG. 4, in which position the rod 132' shown in FIG. 2 establishes a drive to the second or left-hand spindle 30' and the bobbin 32' mounted thereon.

Assuming that the right-hand or first strand or yarn 20 breaks, the following actions or functions are performed by the components of the control unit or stop motion assembly 50. With reference to FIGS. 1 through 4, when the first or right-hand strand or yarn 20 is broken, the tension or force is relieved from the trip wire 138 permitting the counterbalance 148 to move downwardly about the pivot pin 152 whereby the end region of the counterbalance is lowered so that the end 149 of the counterbalance is engaged by the projection 158 of the oscillating member 156.

The oscillation of the shaft 100 with the member 156 in engagement with the counterbalance 148 moves or pivots the counterbalance 148 and member 144 about the axis of the shaft 142. This action moves the member or bar 162 in a counterclockwise direction about the axis of the shaft 142 whereby the counterbalance 148, member 144, and member 162 are moved to the positions shown in FIG. 6.

The counterclockwise movement of member 162 disengages the notch 164 in member 162 from the detent 166 as shown in FIGS. 6 and 7. With the member 162 disengaged from the detent 166, spring means (not shown) urge the rods 130 and 132 to move upwardly causing counterclockwise movement of bell crank 126 about the shaft 124.

The upward movement of the rod 130 disengages the drive to the mandrel supporting the first creel package 18 and the upward movement of rod 132 disengages the drive to the right-hand or first spindle 30 and bobbin 32. With the drive interrupted or disestablished to the creel package 18, the left-hand or second strand 22 continues to be wound upon the left-hand bobbin 32' on the left-hand or second spindle 30'.

Thus continued winding of the strand on the rotating bobbin 32' exerts high tension or stress on the second or left-hand strand 22 because the supply package 18 is not rotating. The tension in strand or yarn 22 builds up immediately and strand or yarn 22 is broken.

Upon breakage of the second or left-hand strand or yarn 22, the trip wire 138' is relieved of the tension or stress and the counterbalance or member 148' is lowered about the axis of the pin 152'. The end of the counterbalance 148' in its lowered position is engaged by the oscillating projection 158' on the oscillating member 156' so that the counterbalance 148' is tilted or moved counterclockwise about the shaft 142' moving the member 174 upwardly about the shaft 142' disengaging the member 174 from the detent or plate 178.

The disengagement of member 174 from the detent 178 causes the bell crank 126' to be moved upwardly which moves the rod 132' upwardly and disestablishes the drive to the second or left-hand spindle 30' and the bobbin 32'.

In this manner the drive to the creel package 18 is interrupted and the drive to both the spindles 30 and 30' is interrupted. The operator may then replace the creel package with a new supply package and engage the right-hand and left-hand strands with the trip wires 138 and 138' and initiate winding of the two strands on the empty bobbins mounted on the spindles 30 and 30'.

When initial winding of the two strands is begun on empty bobbins 32 and 32', tensions are restored in the strands or yarns 20 and 22 which tensions or forces are effective on the trip wires 138 and 138' to elevate the counterbalances 148 and 148' upwardly out of the path of the oscillating projections 158 and 158' mounted by the oscillating members 156 and 156'.

The operator grasps the hand grips 134 and 134' on the members 133 and 133' moving the members 133 and 133' upwardly, which actions pivot the bell cranks 126 and 126' in a clockwise direction about the axes of shafts 124 and 124' lowering the rods 132 and 132' to establish a drive to the right and left-hand spindles 30 and 30' and bobbins 32 and 32' and simultaneously lowering the rod 130 to initiate a drive to the mandrel supporting the first creel package 18.

The clockwise movement of the members 126 and 126' to drive initiating position lowers the members 162 and 174 whereby the notch 164 in member 162 engages the detent 166 and the notch 176 in the member 174 of the unit 52 engages the detent 178, engagement of the detents with these members holding the bell cranks 126 and 126' in drive position for driving both right-hand and left-hand spindles and the creel package 18.

The following is an explanation of functions or actions of the components of the control units or stop assembly devices when the second or left-hand strand or yarn 22 is initially broken. When the left-hand or second strand 22 breaks, the tension on the trip wire 138' is relieved or removed, this action causing the counterbalance 148' to swing downwardly about the pivot pin 152'.

The lowering or downward movement of the counterbalance 148' moves the counterbalance 148' into the path of the oscillating projection 158' of the oscillating member 156' on the shaft 100. The projection 158' engages the end of the counterbalance 148' and moves the counterbalance 148' to a position similar to that of the counterbalance 148 shown in FIG. 6.

The counterbalance 148' moves the member 174 upwardly about the axis of shaft 142' and disengages the notch 176 in the member 174 from the detent 178. Under the influence of the spring means (not shown) urging the rod 132' in an upward direction, the bell crank 126' is moved in a counterclockwise direction about the axis of the shaft 124' disestablishing the drive to the left-hand or second spindle 30' through the movement of the idler roll 44.

The movement of the bell crank 126' about the shaft 124' moves the member 180 upwardly, the member 180 being secured to the end region 128' of member 126'. As the member 180 extends beneath and close to the member 162, as shown in FIGS. 2 and 4, counterclockwise movement of the member 126' about its shaft 124' moves the member 180 upwardly as viewed in FIGS. 2, 6 and 7 moving the member 162 upwardly about the axis of shaft 142 disengaging the detent 166 from the notch 164 in member 162.

The spring means (not shown) normally urging the rods 130 and 132 upwardly move the bell crank 126 counterclockwise about the shaft 124 to release the rods 130 and 132 for upward movement to disestablish or interrupt the drive to the mandrel supporting the first creel package 18 and the drive to the right-hand or first spindle 30 and the bobbin 32.

After the operator rethreads the dual strands from a creel package into engagement with the trip wires 138 and 138' and initiates winding on bobbins mounted on the spindles 30 and 30', the operator grasps both hand grip members 134 and 134' and as hereinbefore mentioned, moves them upwardly, this action rotating the members 126 and 126' in a clockwise direction about the shafts 124 and 124' to move the rods 132, 132' and the creel drive control rod 130 downwardly and thereby initiate the drive to both the right-hand or first spindle 30, the left-hand or second spindle 30' and a drive to the mandrel supporting the first creel package 18 to resume normal winding operations.

The detent 166 is engaged in the notch 164 in the member 162 to retain member 126 in the position shown in FIG. 4 maintaining the control rods 130 and 132 in their lowermost drive-establishing positions, and the detent 178 engages in the notch 176 in the member 174 to hold the bell crank member 126' in its lowermost position with the rod 132' in its lowermost or drive position establishing the drive to the second or left-hand spindle 30' and bobbin 32'.

Through the method and apparatus of the invention adequate control of transferring dual strands or yarns from a creel package onto right-hand and left-hand bobbins enables interruption of the drive to the strand or yarn collecting bobbins and interruption of the drive to the creel package in event of breakage of either a right-hand or left-hand strand or yarn.

It is apparent that, within the scope of the invention, modifications and different arrangements may be made other than as herein disclosed, and the present disclosure is illustrative merely, the invention comprehending all variations thereof.

We claim:

1. Apparatus for transferring dual strands of filamentary material from a single supply package onto first and second bobbins mounted on first and second spindles comprising:

a. a first knockoff device controlling a drive to the first spindle and a drive to the supply package, said first knockoff device having means normally under the influence of tension in the first strand of filamentary material for establishing the drive to the first spindle and the drive to the supply package such that the breakage of the first strand being effective on the first knockoff device to interrupt the drive to the first spindle and the drive to the supply package, b. a second knockoff device having means normally under the influence of tension in the second strand of filamentary material for establishing a drive to the second spindle whereby the interruption of the drive to the supply package interrupts feeding of the strands such that the second strand is broken by tension interrupting the drive to the second spindle, and c. means for establishing interconnection between the second knockoff device with the first knockoff device such that the breakage of the second strand, before breakage of the first strand, interrupts the drive to the second spindle and activates the first knockoff device to interrupt the drive to the first spindle and the supply package.

2. Apparatus for transferring dual strands of filamentary material from a single supply package onto first and second bobbins mounted on first and second spindles comprising:

a. a first control unit controlling the drive to the first spindle and the drive to the supply package, b. a second control unit controlling the drive to the second spindle, c. means including a first trip wire associated with the first control unit engageable with the first strand whereby breakage of the first strand moves the first trip wire to a position activating said first control unit for interrupting the drive to the creel package and the drive to the first spindle, d. a second trip wire associated with the second control unit whereby the interruption of the drive to the creel package interrupts the feeding of the second strand such that the second strand is broken by tension moving the second trip wire to a position activating a mechanism for interrupting the drive to the second spindle, and e. means interengageable from said second control unit with said first control unit whereby breakage or loss of tension in the second strand, before breakage of the first strand, interrupts the drive to both spindles and the drive to the supply package.

* * * * *

UNITED STATES PATENT AND TRADEMARK OFFICE

CERTIFICATE OF CORRECTION

PATENT NO. : 4,418,522

DATED : December 6, 1983

INVENTOR(S) : Kenneth T. Harrop and Robert D. McArtor

It is certified that error appears in the above-identified patent and that said Letters Patent is hereby corrected as shown below:

Column 1, line 43, the word "would" should be changed to --wound--.

Column 1, line 59, the word "associted" should be changed to --associated--.

Column 5, line 2, the word "a" should be changed to --the--.

Column 7, line 18, the word "driven" should be changed to --drive--.

Signed and Sealed this

*Fifth* Day of *February 1985*

[SEAL]

*Attest:*

DONALD J. QUIGG

*Attesting Officer* *Acting Commissioner of Patents and Trademarks*